US006269728B1

(12) United States Patent
Kern et al.

(10) Patent No.: US 6,269,728 B1
(45) Date of Patent: Aug. 7, 2001

(54) INDUCTIVE IGNITION SYSTEM, IN PARTICULAR FOR INFANTRY WEAPONS

(75) Inventors: Heinz Kern, Furth; Gerhard Kordel, Nuremberg; Gerhard Schmidtner, Cologne, all of (DE)

(73) Assignee: Dynamit Nobel GmbH Explosivstoff und Systemtechnik, Troisdorf (DE)

( * ) Notice: Subject to any disclaimer, the term of this patent is extended or adjusted under 35 U.S.C. 154(b) by 0 days.

(21) Appl. No.: 09/367,718

(22) PCT Filed: Feb. 17, 1998

(86) PCT No.: PCT/EP98/00889

§ 371 Date: Nov. 8, 1999

§ 102(e) Date: Nov. 8, 1999

(87) PCT Pub. No.: WO98/37375

PCT Pub. Date: Aug. 27, 1998

(30) Foreign Application Priority Data

Feb. 21, 1997 (DE) ..... 197 06 863

(51) Int. Cl.[7] ..... F41A 19/61

(52) U.S. Cl. ..... 89/28.05; 89/28.1; 89/135; 42/84

(58) Field of Search ..... 42/85; 89/28.05, 89/28.1, 28.2, 135

(56) References Cited

U.S. PATENT DOCUMENTS 2,459,854 * 1/1949 Swift, Jr. ..... 42/84
3,038,384 * 6/1962 Gaugler ..... 89/28.05
3,651,736 * 3/1972 Ingram ..... 89/132
4,653,211 * 3/1987 Brede et al. ..... 42/84

FOREIGN PATENT DOCUMENTS

235010 * 9/1987 (EP) ..... 89/135

* cited by examiner

*Primary Examiner*—Stephen M. Johnson
(74) *Attorney, Agent, or Firm*—Antonelli, Terry, Stout & Kraus, LLP

(57) ABSTRACT

The invention relates to an inductive ignition system, in particular for infantry weapons, having a primary coil (2) which cooperates inductively with a secondary coil (3) in the ignition system of cartridge (4) and which transmits the firing energy that is required for the ignition. For the necessary firing energy to be produced and made available internally, that is with additional supply, the invention proposes fitting a weapon breechblock component (5), displaceable from a cocked position to a firing position, in the weapon housing (1) in which is located the primary coil (2), and that, for production of the ignition energy, an inductive power generator (6) is provided whose coil system (7) is fitted in the weapon breechblock component (5) and whose magnet system (8) is fitted in the weapon housing (1). On displacing the weapon breechblock component (5) from the cocked position to the firing position, the coil system slides pass the magnet system (8) and induces the necessary ignition energy in the coil system (7).

4 Claims, 3 Drawing Sheets

INDUCTIVE IGNITION SYSTEM, IN PARTICULAR FOR INFANTRY WEAPONS

BACKGROUND OF THE INVENTION

The invention relates to an inductive ignition system, in particular for infantry weapons, having a primary coil which cooperates inductively with a secondary coil in the ignition system of a cartridge and which transmits the ignition energy that is required for ignition.

Inductive ignition is preferably used for automatic weapons in the mid-calibre range. To this end, a primary coil which cooperates inductively with a secondary coil in the ignition system of the cartridge and which transmits the firing power that is required for the ignition is arranged in the weapon housing. The ignition energy is made available by means of an external supply (battery, on-board system, etc). Cables need to be laid for this. An example of a secondary coil for the cartridge is described in DE 32 31 369 C1.

SUMMARY OF THE INVENTION

The underlying object of the invention is to develop further an inductive ignition system so that the ignition energy that is required is generated and made available internally, that is, without an additional supply.

In accordance with the invention the object is achieved in that a weapon breechblock component which can be moved from a cocked position into a firing position and in which the primary coil is located is arranged in the weapon housing, and in that an inductive power generator, the coil system of which is arranged in the weapon breechblock component and the magnet system of which is arranged in the weapon housing, is provided for the purpose of generating the firing energy, with the coil system sliding past the magnet system and inducing the necessary ignition energy in the coil system when the weapon breechblock component is moved from the cocked position into the firing position.

An electronic circuit arrangement for the intermediate storage and/or processing of the ignition energy generated in the coil system of the power generator and for the timely retransmission thereof to the primary coil is advantageously provided in the weapon breechblock component. It is expedient to use a capacitor for the intermediate storage and to use a rectifier for the processing.

The weapon breechblock component can preferably be moved from the firing position into the cocked position in opposition to the force of a spring, and is moved by way of a loading lever for the purposes of being cocked.

The solution to the problem of achieving the object in accordance with the invention is characterised by the following features:

a) The ignition energy is generated by means of an inductive power generator. As a result of "passing by" permanent magnets, a coil system experiences a magnetic flux of alternating magnetic fields, in which case an induced voltage is tapped off at the terminals of the coil system.

b) The necessary displacement for the generation of the induced voltage is achieved by means of the internal weapon kinematics (relative displacement of the weapon breechblock component in relation to the fixed housing).

c) The intermediate storage of the energy for firing the cartridge takes place in an energy circuit (capacitor) and for the purpose of firing the cartridge by means of a suitable electronics unit, which is not described in greater detail, the energy circuit is coupled by way of an inductive transmission system (primary coil in the weapon breechblock component, secondary coil in the cartridge) with the inductive igniter of the cartridge. The ignition of the cartridge is triggered.

Special features are:

The inductive power generator is part of the fixed weapon housing and also the movable weapon breechblock component.

The ignition energy storage or intermediate storage in the capacitor and the function-related energy transfer to the cartridge by way of a suitable control electronics unit is integrated in the movable weapon breechblock component.

The invention therefore has the following advantages:

External energy supply is done away with.

Conditionally upon the functional sequence in the weapon, no additional safety device is required for the functional electronics to prevent unintentional firing release.

Electrical connections between energy generation, energy store and inductive circuit are not critical.

All the electrical functional components are integral parts of the weapon breechblock component; exchange is possible in a problem-free, rapid manner as a result of a replacement part (weapon breechblock component).

Located in the weapon breechblock component (displaceable)—also called breechblock in the following—are the primary coil, a control electronics unit that is not denoted in greater detail and which releases the energy stored in the capacitor (generated by means of an inductive power generator) to the primary coil when the cartridge is located in the cartridge chamber and the breechblock is securely closed. (An interrogation may possibly be carried out beforehand by way of a sensor, or an electronic time delay may be provided. It must be made certain that the breechblock is actually closed as well). The power generator is "quasi" divided into two.

Coils, which are wound over a soft magnetic yoke, are located in the weapon breechblock component. Permanent magnets are located in the fixed weapon housing. The two portions are arranged in such a way that when on the basis of the "command to fire" the weapon breechblock component travels from the cocked position into the firing position (during this process the cartridge is simultaneously shifted into the cartridge chamber), the soft magnetic yoke and the magnets come into a position in which they coincide and as a result of this a change in the magnetic flux occurs in the soft magnetic yoke that induces a voltage in the coils. This voltage pulse (an attenuated oscillation) is fed by way of a rectifier circuit arrangement to the capacitor and charges the latter. For the purposes of the ignition, the energy stored in the capacitor is discharged to the primary coil by way of an electronic switch. In this connection, an alternating magnetic field in turn develops that is coupled into the inductive igniter of the cartridge; the process of igniting the cartridge is triggered. The weapon breechblock component travels back again. The process begins anew (for example in the case of continuous fire or a burst of fire).

If the weapon is to be activated for the first delivery of a shot, the weapon breechblock component is brought, with the aid of a suitable device (for example a loading lever), into the starting position (it is then in the cocked position). If a shot is to be discharged, the weapon breechblock component is moved forwards by way of the trigger and a corresponding mechanism; the functional sequence is in accordance with the process described.

BRIEF DESCRIPTION OF THE DRAWINGS

Further features follow from the figures which are described below and in which.

DETAILED DESCRIPTION OF THE PREFERRED EMBODIMENTS

Figure 1:
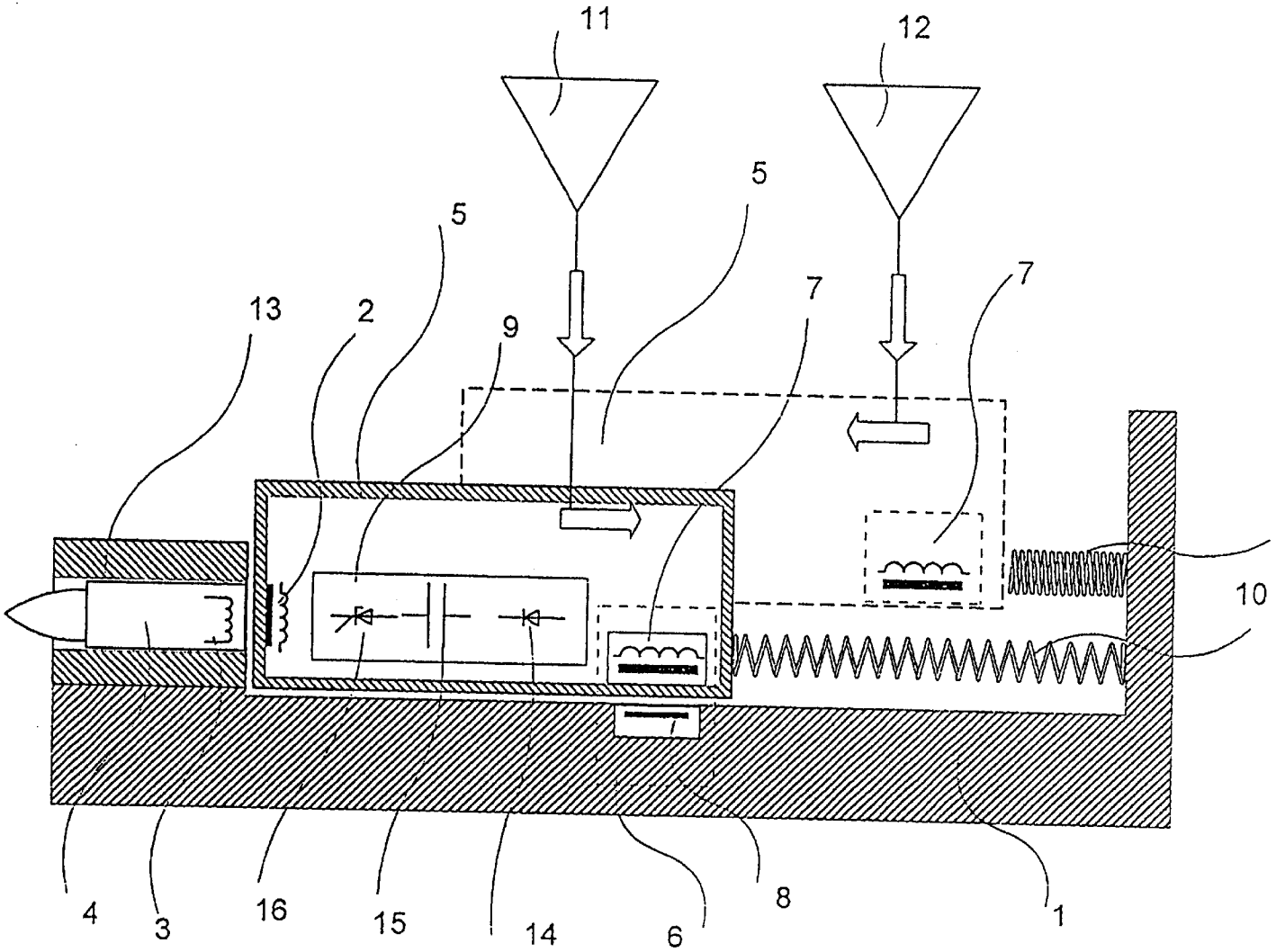
FIG. 1 diagrammatically shows the mode of functioning of the inductive ignition system in accordance with the invention.

FIG. 1 diagrammatically shows the mode of functioning of an inductive ignition system for infantry weapons. A displaceable weapon breechblock component 5, also simply called a breechblock, is arranged in a weapon housing 1. Adjacent the weapon breechblock component 5 there is a barrel 13 in which a cartridge 4 has just been inserted. The way in which the cartridge is fed in is not shown.

Arranged in the weapon breechblock component 5 is a coil system 7 which, together with a magnet system arranged in the weapon housing 1, constitutes a power generator 6. Moreover, an electronic circuit arrangement 9 with, by way of example, a rectifier 14, a capacitor 15 and an electronic switch 16 is located in the weapon breechblock component 5. Arranged at the end facing the cartridge 4 is a primary coil 2 which, in the event of ignition, transmits energy to a secondary coil 3 arranged in the cartridge 4.

If the weapon is loaded, then the weapon breechblock component 5 is moved by means of the loading lever 11 (only indicated diagrammatically) into a cocked position in opposition to the force of a spring 10. This cocked position is shown in broken lines in the drawing. The spring 10 is tensioned and has the aim of pushing the weapon breechblock component back into the firing position (previously described). Upon firing, a trigger 12 (firing lever etc.) is actuated and the weapon breechblock component 5 is moved from the cocked position into the firing position. The coil system 7 in the weapon breechblock component 5 then slides past the magnet system 8 in the weapon housing 1. As a result, an ignition voltage is generated in the coil system 7 and is transmitted to an electronic circuit arrangement 9. The connecting wires or printed conductors are not shown. This electronic circuit arrangement 9 contains at least one capacitor 15, a rectifier 14 and an electronic switch 16. Moreover, a timer or a time-delay circuit arrangement, which only applies the ignition voltage to the primary coil 2 when the weapon breechblock component 5 is in the firing position, should also be contained therein. It must previously be ensured that the weapon breechblock component 5 is actually in the firing position as well. This could be done, for example, by way of a sensor element.

When the ignition voltage is applied to the primary coil 2, a voltage is induced in the secondary coil 3 in the cartridge 4 that results in the cartridge 4 being ignited.

Figure 2:
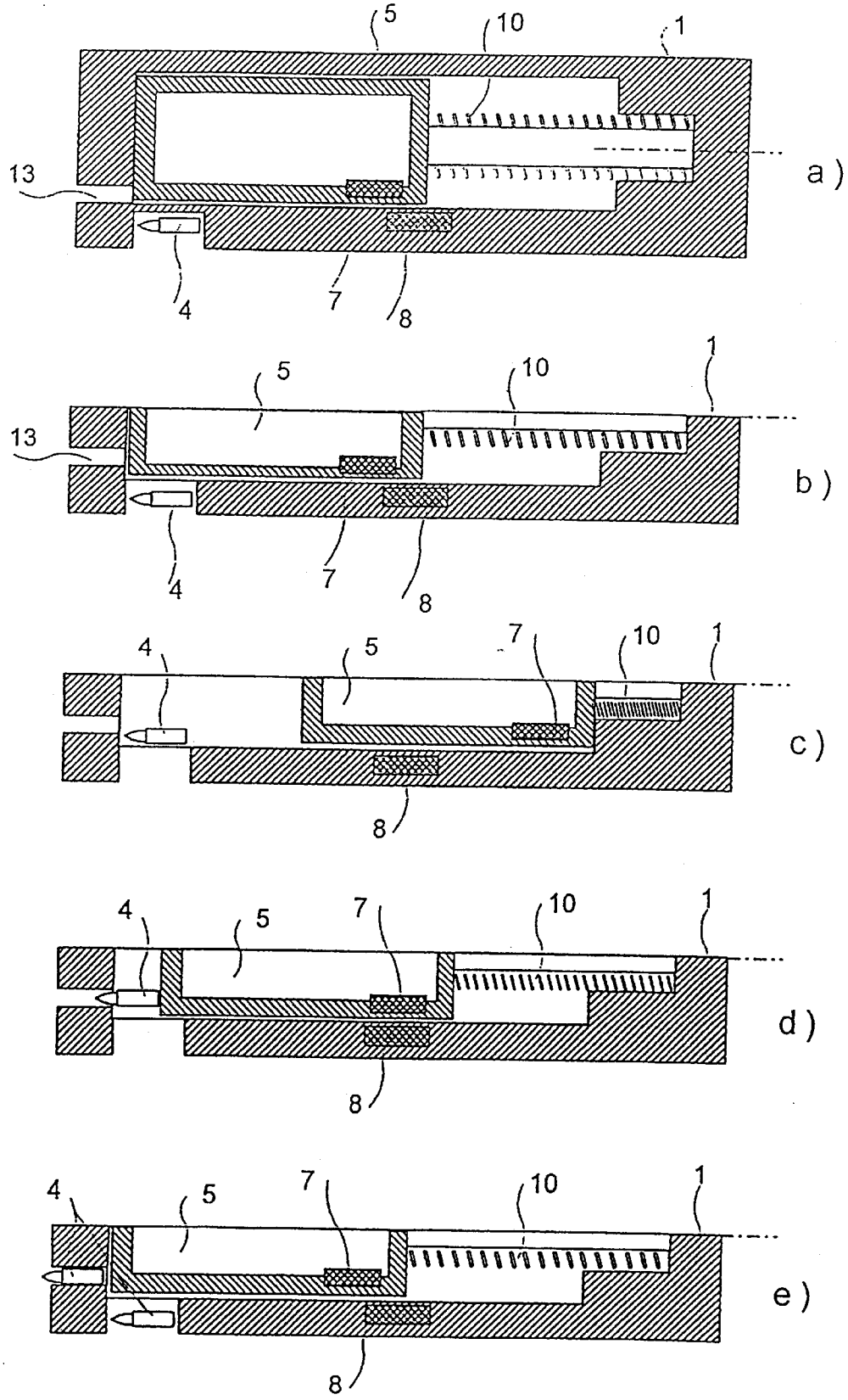
FIGS. 2*a*–2*e* show the mode of functioning of the invention in sections through a weapon housing with a displaceable breechblock.

FIG. 2 shows the mode of functioning of the inductive ignition system in individual sections. FIG. 2*a* in a section shows a weapon housing 1 in which a displaceable weapon breechblock component 5 is arranged. A cartridge 4 is located in the feed, although not yet in the barrel 13. As already described, a coil system 7 is arranged in the weapon breechblock component 5, and a magnet system 8 is arranged in the weapon housing 1. Together the two constitute a power generator.

What is not shown is that an electronic circuit arrangement and a primary coil (see FIG. 1) are additionally located in the weapon breechblock component 5. FIG. 2*a* shows the weapon breechblock component 5 in its firing position. The spring 10 is released.

FIG. 2*b* shows the same subject matter as FIG. 1*a* (sic), except that the upper portion is cut away. FIGS. 2*c, d, e* show the same section.

In FIG. 2*c* the weapon breechblock component 5 is in its cocked position. The spring 10 is tensioned and has the aim of moving the weapon breechblock component 5 into its firing position. A cartridge 4 is located in front of the barrel 13.

If firing is triggered, the weapon breechblock component 5 is moved in the direction of the firing position. This is shown in FIG. 2*d*. In this connection, the coil system 7 slides past the magnet system 8 and a voltage is induced in the coil system 7. This voltage is stored in the electronic circuit arrangement, which is not shown, or the capacitor.

FIG. 2*e* shows the weapon breechblock component 5 in its firing position. The electronic circuit arrangement or the capacitor as the case may be release their stored energy to the primary coil which is not shown (see FIG. 1), and this induces in the secondary coil in the cartridge 4 a voltage which ignites the cartridge 4. The weapon breechblock component 5 has previously pushed the cartridge 4 further into the barrel 13.

Figure 3:
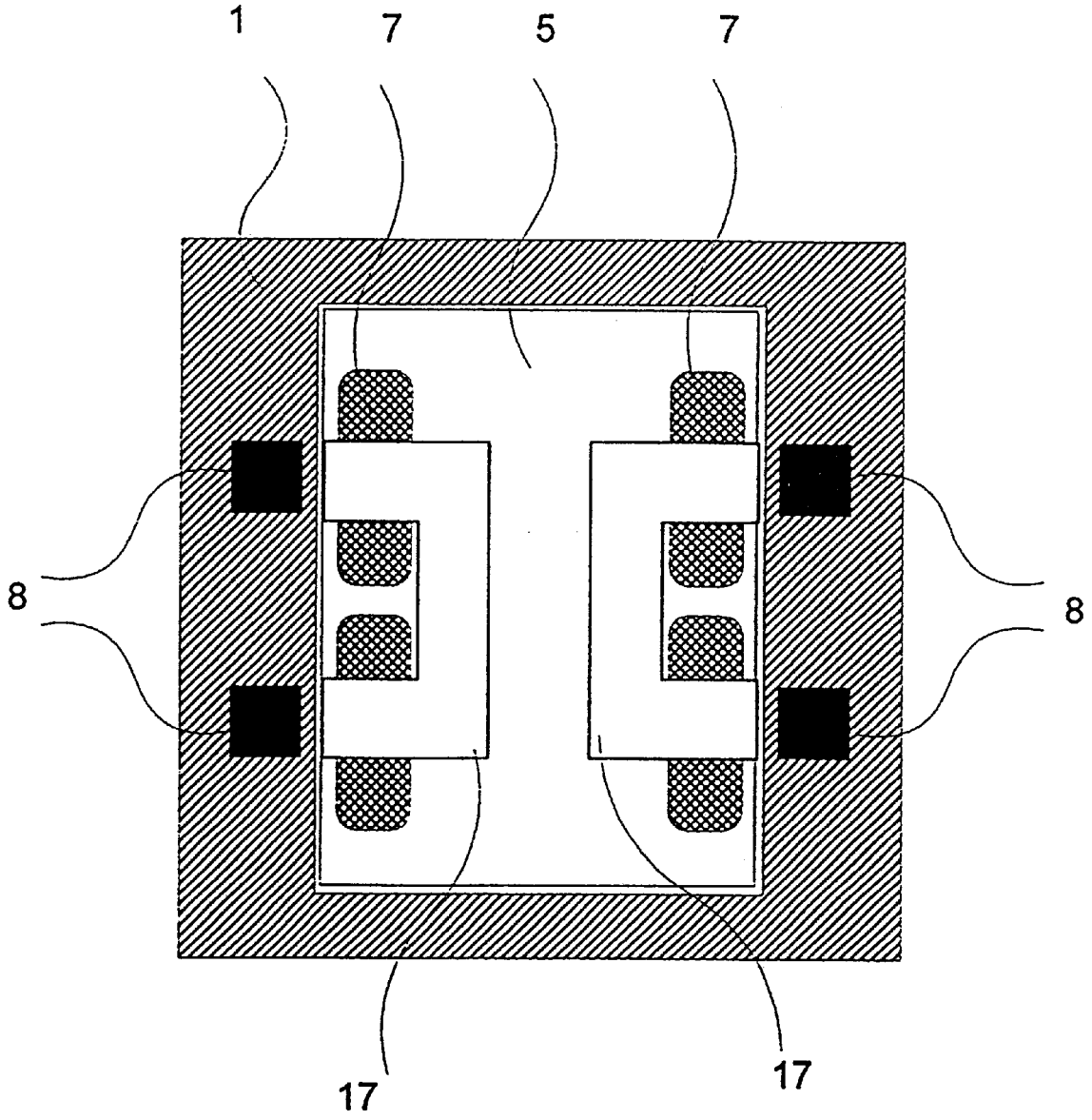
FIG. 3 shows the inductive power generator or the arrangement of the coil system in the breechblock and the arrangement of the magnet system in the weapon housing.

FIG. 3 shows the inductive power generator which consists of a coil system 7 in the weapon breechblock component 5 and a magnet system 8 in the weapon housing 1. The coil system 7 consists of a soft magnetic yoke 17 on which coils are wound. Two or more power generators are preferably arranged in the weapon breechblock component 5.

What is claimed is:

1. Inductive ignition system, for weapons, comprising:

a weapon housing;

a weapon breechblock component which can be moved from a cocked position into a firing position arranged in the weapon housing;

a primary coil provided in the breechblock component, the primary coil cooperating inductively with a secondary coil in an ignition system of a cartridge and transmitting ignition energy required for ignition;

an inductive power generator comprising a coil system of arranged in the weapon breechblock component and a magnet system arranged in the weapon housing for the purpose of generating firing energy, the coil system sliding past the magnet system and inducing the necessary ignition energy in the coil system when the weapon breechblock component is moved from the cocked position into the firing position.

2. Inductive ignition system according to claim 1, further compresing an electronic circuit arrangement for intermediate storage and/or processing of the ignition energy induced in the coil system of the power generator and for timely retransmission thereof to the primary coil provided in the weapon breechblock component.

3. Inductive ignition system according to claim 1, wherein the weapon breechblock component can be moved from the firing position into the cocked position in opposition to the force of a spring.

4. Ignition system according to one of claim 1, wherein the weapon breechblock component can be moved from the firing position into the cocked position by means of a loading lever.

* * * * *